US009459543B1

(12) United States Patent
Korenaga et al.

(10) Patent No.: US 9,459,543 B1
(45) Date of Patent: Oct. 4, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Jiro Korenaga, Kanagawa (JP); Yoshifumi Shoji, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/836,547

(22) Filed: Aug. 26, 2015

(30) Foreign Application Priority Data

Mar. 24, 2015 (JP) ..... 2015-061675

(51) Int. Cl.
*G03G 5/04* (2006.01)
*G03G 5/06* (2006.01)
*G03G 5/047* (2006.01)

(52) U.S. Cl.
CPC ..... *G03G 5/0618* (2013.01); *G03G 5/047* (2013.01); *G03G 5/0601* (2013.01); *G03G 5/0609* (2013.01); *G03G 5/0612* (2013.01)

(58) Field of Classification Search
CPC ..... G03G 5/0601; G03G 5/0609; G03G 5/0612; G03G 5/0696
See application file for complete search history.

(56) References Cited

U.S. PATENT DOCUMENTS 5,910,610 A 6/1999 Kobayashi et al.
5,989,765 A 11/1999 Kobayashi et al.

(Continued)

FOREIGN PATENT DOCUMENTS

JP H06-123981 A 5/1994
JP H08-295655 A 11/1996

(Continued)

*Primary Examiner* — Peter Vajda
(74) *Attorney, Agent, or Firm* — Oliff PLC

(57) ABSTRACT

An electrophotographic photoreceptor includes a conductive substrate and a singlelayer type photosensitive layer which is provided on the conductive substrate and contains a binder resin, a charge generating material, a hole transporting material, an electron transporting material represented by the formula (1), and a fluorenone compound represented by the formula (2):

(1)

wherein $R^{11}$, $R^{12}$, $R^{13}$, $R^{14}$, $R^{15}$, $R^{16}$, $R^{17}$ each independently represent a hydrogen atom, a halogen atom, an alkyl group, an alkoxy group, an aryl group, or an aralkyl group, and $R^{18}$ represents an alkyl group, an aryl group, or an aralkyl group; and (2)

wherein $R^{21}$, $R^{22}$, $R^{23}$, $R^{24}$, $R^{26}$, $R^{27}$, and $R^{28}$ each independently represent a hydrogen atom, a halogen atom, an alkyl group, an alkoxy group, an aryl group, or an aralkyl group, and $R^{25}$ represents a hydrogen atom, a halogen atom, an alkyl group, an alkoxy group, an aryl group, or an aralkyl group.

11 Claims, 2 Drawing Sheets

(56) References Cited

U.S. PATENT DOCUMENTS

| | | | | |
|---|---|---|---|---|
| 6,172,264 | B1 | 1/2001 | Kobayashi et al. | |
| 7,291,432 | B2 * | 11/2007 | Lin | G03G 5/04 430/56 |
| 2005/0164106 | A1 | 7/2005 | Bender et al. | |
| 2013/0288169 | A1 | 10/2013 | Yamano et al. | |

FOREIGN PATENT DOCUMENTS

| | | | |
|---|---|---|---|
| JP | 2005-215677 | A | 8/2005 |
| JP | 2008-015208 | A | 1/2008 |
| JP | 2013-231867 | A | 11/2013 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-061675 filed Mar. 24, 2015.

BACKGROUND

1. Technical Field

The invention relates to an electrophotographic photoreceptor, a process cartridge, and an image forming apparatus.

2. Related Art

In an image forming apparatus in an electrophotographic system in the related art, a toner image formed on the surface of an electrophotographic photoreceptor is transferred to a recording medium through charging, electrostatic latent image-forming, developing, and transfer processes.

It is known that a charge transporting material having increased charge transportability is used in a photosensitive layer of an electrophotographic photoreceptor used in an image forming apparatus of such an electrophotographic system.

SUMMARY

According to an aspect of the invention there is provided an electrophotographic photoreceptor including:

a conductive substrate; and a singlelayer type photosensitive layer which is provided on the conductive substrate and contains a binder resin, a charge generating material, a hole transporting material, an electron transporting material represented by the formula (1), and a fluorenone compound represented by the formula (2):

(1)

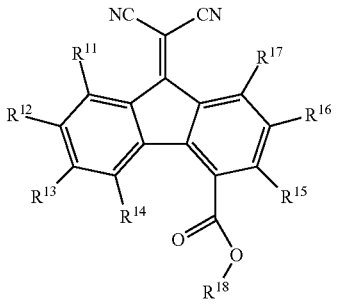

wherein $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group, and $R^{18}$ represents an alkyl group, an aryl group, or an aralkyl group; and (2)

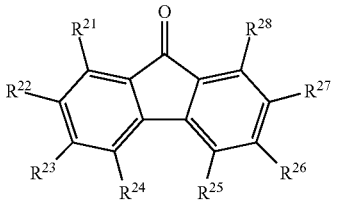

wherein $R^{21}$, $R^{22}$, $R^{23}$, $R^{24}$, $R^{26}$, $R^{27}$, and $R^{28}$ each independently represent a hydrogen atom, a halogen atom, an alkyl group, an alkoxy group, an aryl group, or an aralkyl group, and $R^{25}$ represents a hydrogen atom, a halogen atom, an alkyl group, an alkoxy group, an aryl group, or an aralkyl group.

BRIEF DESCRIPTION OF THE DRAWINGS

Exemplary embodiments of the present invention will be described in detail, based on the following figures, wherein.

DETAILED DESCRIPTION

Figure 1:
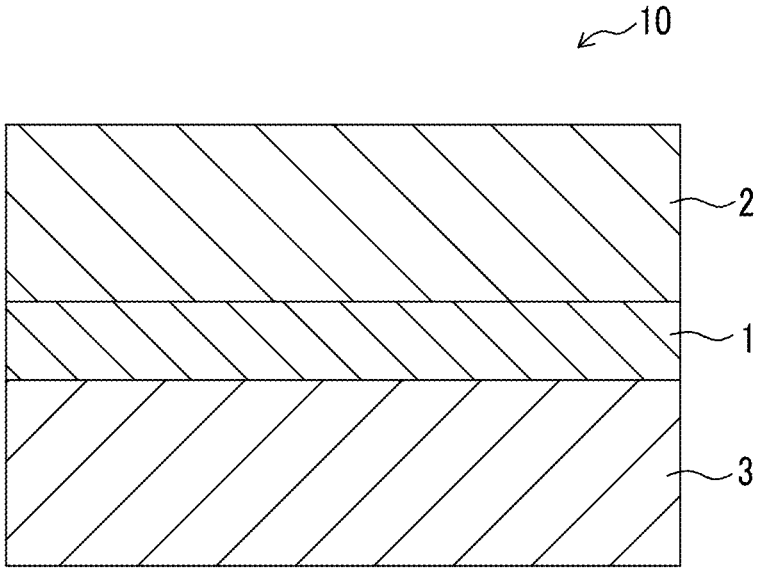
FIG. 1 is a schematic partial cross-sectional view showing an electrophotographic photoreceptor according to the present exemplary embodiment.

An exemplary embodiment which is an example of the invention will be described in detail below.

Electrophotographic Photoreceptor

An electrophotographic photoreceptor according to the present exemplary embodiment is a positively charged organic photoreceptor (hereinafter also simply referred to as a "photoreceptor" or a "singlelayer type photoreceptor"), including a conductive substrate and having a singlelayer type photosensitive layer provided on the conductive substrate.

Furthermore, the singlelayer type photosensitive layer includes a binder resin, a charge generating material, a hole transporting material, and an electron transporting material represented by the formula (1) (hereinafter also referred to as "electron transporting material of the formula (1)"), and a fluorenone compound represented by the formula (2) (hereinafter also referred to as a "fluorenone compound of the formula (2)").

In addition, the singlelayer type photosensitive layer is a photosensitive layer having charge generating capabilities as well as hole transporting properties and electron transporting properties.

The electrophotographic photoreceptor according to the present exemplary embodiment prevents generation of color spots which generate when images are repeatedly formed in a high-temperature and high-humidity environment (for example, in an environment of 28° C. and 85%) by the configuration above. The reason therefor is not clear, but is presumed to be as follows.

First, since a singlelayer type photoreceptor is configured to include a charge generating material, a hole transporting material, and an electron transporting material in a photosensitive layer in a singlelayer type, it is impossible to obtain sensitivity equivalent to that of an organic photoreceptor having a laminate-type photosensitive layer, and in addition, there is an additional demand for higher sensitivity.

From this viewpoint, the electron transporting material of the formula (1) have high electron transportability, and a singlelayer type photosensitive layer including the electron transporting material of the formula (1) is promoted to have high sensitivity.

However, when images are repeatedly formed by using a singlelayer type photoreceptor having the singlelayer type photosensitive layer in a high-temperature and high-humidity environment (for example, in an environment of 28° C. and 85%), color spots are generated in some cases. Specifically, this process is as follows. Since a rubber roll (for example, a charging roll, a developing roll, and a transfer roll) comes into contact with the singlelayer type photoreceptor, the surface of the singlelayer type photosensitive layer is contaminated with precipitates (bleeding products) of rubber components precipitated from a rubber roll. Particularly, the precipitation amount (bleeding amount) of the rubber components precipitated from the rubber roll is increased in a high-temperature and high-humidity environment, and the contamination of the surface of the singlelayer type photosensitive layer with precipitates of the rubber components is increased. Under this situation, when an image is repeatedly formed, the contamination of the surface of the singlelayer type photosensitive layer with the precipitates of the rubber components is further increased. By this, it is considered that the precipitates of the rubber components are penetrated into the inside of the singlelayer type photosensitive layer, whereby cleavages (chemical cracks) of the singlelayer type photosensitive layer are generated. It is also considered that in the places where the cleavages (chemical cracks) of the singlelayer type photosensitive layer are generated, color spots are generated.

On the other hand, when the singlelayer type photosensitive layer further includes a fluorenone compound of the formula (2), in addition to a binder resin, a charge generating material, a hole transporting material, and the electron transporting material of the formula (1), in the singlelayer type photosensitive layer, the glass transition temperature is lowered and the elasticity is increased. Therefore, it is presumed that the fluorenone compound of the formula (2) acts as an anti-plasticizer. It is also presumed that the action of the fluorenone compound of the formula (2) as an anti-plasticizer is exerted by allowing the compound to intervene between molecules of the binder resin at a molecular level. In addition, it is considered that when the fluorenone compound of the formula (2) intervenes between the molecular chains of the binder resin to exert an action as an anti-plasticizer, the precipitates of the rubber layer components from the rubber roll are prevented from invading into the inside of the singlelayer type photosensitive layer. Based on this, it is considered that even when images are repeatedly formed in a high-temperature and high-humidity environment (for example, in an environment of 28° C. and 85%), cleavages (generation of chemical cracks) of the singlelayer type photosensitive layer, which cause generation of color spots, are prevented.

From the description above, it is presumed that the electrophotographic photoreceptor according to the present exemplary embodiment prevents generation of color spots which generate when images are repeatedly formed in a high-temperature and high-humidity environment (for example, in an environment of 28° C. and 85%).

Incidentally, in the electrophotographic photoreceptor according to the present exemplary embodiment, the precipitation of the respective components (an electron transporting material and the like) of the singlelayer type photosensitive layer is prevented by the action as an anti-plasticizer of the fluorenone compound of the formula (2), and the contamination with a member (for example, rubber rolls such as a charging roll, a developing roll, and a transfer roll) in contact with the photoreceptor is also prevented.

Particularly, when a polycarbonate resin is applied as a binder resin in the electrophotographic photoreceptor according to the present exemplary embodiment, the generation of color spots which generate when images are repeatedly formed in a high-temperature and high-humidity environment is easily prevented. This is presumably due to the fact that the fluorenone compound of the formula (2) strongly interacts with a "C═O" group contained in the polycarbonate resin, and thus, the action as an anti-plasticizer is easily exerted.

The electrophotographic photoreceptor according to the present exemplary embodiment will be described in detail with reference to the drawings below.

FIG. 1 schematically shows a cross-section of a part of an electrophotographic photoreceptor 10 according to the present exemplary embodiment.

The electrophotographic photoreceptor 10 shown in FIG. 1 is configured to be provided with, for example, a conductive and an undercoat layer 1 and a singlelayer type photosensitive layer 2 provided in this order on the conductive substrate 3.

Incidentally, the undercoat layer 1 is a layer which is provided, as desired. That is, the singlelayer type photosensitive layer 2 may be provided on the conductive substrate 3 directly or via the undercoat layer 1.

In addition, other layers may be provided, as desired. Specifically, for example, a protective layer may be provided on the singlelayer type photosensitive layer 2, as desired.

The respective layers of the electrophotographic photoreceptor according to the present exemplary embodiment will be described in detail below. Further, the explanations will be made with omission of the reference numerals.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm to prevent interference fringes which are formed when irradiated with laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

Examples of the method for surface roughening include wet honing in which an abrasive suspended in water is blown onto a conductive substrate, centerless grinding in which a support is continuously ground by pressing a conductive substrate onto a rotating grind stone, and an anodic oxidation treatment.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably, for example, from 0.3 μm to 15 μm. When the film thickness is within the above range, a barrier property against injection tends to be exerted and an increase in the residual potential caused by the repeated use tends to be prevented.

The conductive substrate may be subjected to a treatment with an acidic treatment solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing the substrate into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, 10 $m^2/g$ or more. The volume average particle diameter of the inorganic particles is, for example, preferably from 50 nm to 2,000 nm (more preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be those which have been subjected to a surface treatment. The inorganic particles which have been subjected to different surface treatments or have different particle diameters may be used in combination of two or more kinds.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron accepting compound (acceptor compound) are preferably included in the undercoat layer from the viewpoint of superior long-term stability of electrical characteristics and carrier blocking properties.

Examples of the electron accepting compound include an electron transporting material including, for example, quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron accepting compound, compounds having an anthraquinone structure are preferable. As the electron accepting compounds having an anthraquinone structure, for example, hydroxyanthraquinone compounds, amino anthraquinone compounds, aminohydroxyanthraquinone compounds, and the like are preferable, and specifically, anthraquinone, alizarin, quinizarin, anthrarufin, purpurin, and the like are preferable.

The electron accepting compound may be included as dispersed with the inorganic particles in the undercoat layer, or may be included as attached to the surface of the inorganic particles.

Examples of the method of attaching the electron accepting compound to the surface of the inorganic particles include a dry method and a wet method.

The dry method is a method for attaching an electron accepting compound to the surface of the inorganic particles, in which the electron accepting compound is added dropwise to the inorganic particles or sprayed thereto together with dry air or nitrogen gas, either directly or in the form of a solution in which the electron accepting compound is dissolved in an organic solvent, while the inorganic particles are stirred with a mixer or the like having a high shearing force. The addition or spraying of the electron accepting compound is preferably carried out at a temperature no higher than the boiling point of the solvent. After the addition or spraying of the electron accepting compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron accepting compound to the surface of the inorganic particles, in which the inorganic particles are dispersed in a solvent by means of stirring, an ultrasonic wave, a sand mill, an attritor, a ball mill, or the like, then the electron accepting compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron accepting compound may be carried out before or after the inorganic particles are subjected to a surface treatment using a surface treatment agent, and the attachment of the electron accepting compound may be carried out at the same time with the surface treatment using a surface treatment agent.

The content of the electron accepting compound is, for example, preferably from 0.01% by weight to 20% by weight, and more preferably from 0.01% by weight to 10% by weight, based on the inorganic particles.

Examples of the binder resin used in the undercoat layer include known materials including, for example, known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transporting resins having charge transporting groups, and conductive resins (for example, polyaniline).

Among these, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable. In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for the surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more kinds thereof.

The Vickers hardness of the undercoat layer is preferably 35 or more.

The surface roughness of the undercoat layer (ten point height of irregularities) is adjusted in the range of $(1/(4n))\lambda$ to $(1/2)\lambda$, in which X represents the wavelength of the laser for exposure and n represents a refractive index of the upper layer, in order to prevent a moire image. Resin particles and the like may be added in the undercoat layer in order to adjust the surface roughness. Examples of the resin particles include silicone resin particles and crosslinked polymethyl methacrylate resin particles. In addition, the surface of the undercoat layer may be polished in order to adjust the surface roughness. Examples of the polishing method include buff polishing, a sandblasting treatment, wet honing, and a grinding treatment.

The formation of the undercoat layer is not particularly limited, and known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include alcohol solvents, aromatic hydrocarbon solvents, hydrocarbon halide solvents, ketone solvents, ketone alcohol solvents, ether solvents, and ester solvents. Examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

Further, as a method for coating the coating liquid for forming an undercoat layer onto a conductive substrate include ordinary methods such as a blade coating method, a wire bar coating method, a spraying method, a dipping coating method, a bead coating method, an air knife coating method, and a curtain coating method.

The film thickness of the undercoat layer is set to a range of, for example, preferably 15 μm or more, and more preferably from 20 μm to 50 μm.

Intermediate Layer

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organic metal compound. Examples of the organic metal compound used in the intermediate layer include organic metal compounds containing a metal atom such as zirconium, titanium, aluminum, manganese, and silicon. These compounds used in the intermediate layer may be used singly or as a mixture or a polycondensate of plural compounds.

Among these, layers containing organometallic compounds containing a zirconium atom or a silicon atom are preferable.

The formation of the intermediate layer is not particularly limited, and known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Singlelayer Type Photosensitive Layer

The singlelayer type photosensitive layer of the present exemplary embodiment includes a binder resin, a charge generating material, a hole transporting material, an electron transporting material, and a fluorenone compound.

Binder Resin

The binder resin is not particularly limited, and examples thereof include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, a poly-N-vinylcarbazole, and a polysilane. These binder resins may be used singly or as a mixture of two or more kinds thereof.

Among these binder resins, in particular, from the viewpoint of prevention of the generation of color spots, a polycarbonate resin is preferable, and from the viewpoint of prevention of the generation of color spots as well as film forming properties of the photosensitive layer, for example, a polycarbonate resin having a viscosity average molecular weight of 30,000 to 80,000 is more preferable.

The content of the binder resin with respect to the total solid content of the photosensitive layer is from 35% by weight to 60% by weight, and preferably from 20% by weight to 35% by weight.

Charge Generating Materials

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these, in order to corresponding to laser exposure in the near-infrared region, it is preferable to use metal or nonmetal phthalocyanine pigments as the charge generating material, and specifically, hydroxygallium phthalocyanine, and the like; chlorogallium phthalocyanine and the like; dichlorotin phthalocyanine, and the like; and titanyl phthalocyanine and the like are more preferable.

On the other hand, in order to corresponding to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments; and the like are preferable.

That is, as a charge generating material, for example, in the case of using a light source having an exposure wavelength of 380 nm to 500 nm, an inorganic pigment is preferable, and in the case of using a light source having an exposure wavelength of 700 nm to 800 nm, metal and non-metal phthalocyanine pigments are preferable.

Here, as the charge generating material, at least one selected from a hydroxygallium phthalocyanine pigment and a chlorogallium phthalocyanine pigment is preferable, and a hydroxygallium phthalocyanine pigment is more preferable, from the viewpoint of obtaining higher sensitivity of the singlelayer type photoreceptor.

The hydroxygallium phthalocyanine pigment is not particularly limited, and is preferably a Type V hydroxygallium phthalocyanine pigment.

Particularly, as the hydroxygallium phthalocyanine pigment, for example, a hydroxygallium phthalocyanine pigment having a maximum peak wavelength in the range of 810 nm to 839 nm in a spectral absorption spectrum in a wavelength band of 600 nm to 900 nm is preferable from the viewpoint of obtaining excellent dispersibility. In the case of using the hydroxygallium phthalocyanine pigment as a material for an electrophotographic photoreceptor, it becomes easy to obtain excellent dispersibility, sufficient sensitivity, chargeability, and dark decay characteristics.

Furthermore, it is preferable that the hydroxygallium phthalocyanine pigment having a maximum peak wavelength in the range of 810 nm to 839 nm has an average particle diameter in a specific range, and a BET specific surface area in a specific range. Specifically, the average particle diameter is preferably 0.20 μm or less, and more preferably from 0.01 μm to 0.15 μm, and on the other hand, the BET specific surface area is preferably 45 $m^2/g$ or more, more preferably 50 $m^2/g$ or more, and particularly preferably from 55 $m^2/g$ to 120 $m^2/g$. The average particle diameter is a value measured as a volume average particle diameter (d50 average particle diameter), using a laser diffraction scattering type particle size distribution measuring device (LA-700, manufactured by Horiba, Ltd.). Further, the BET specific surface area is a value obtained by a nitrogen purging method, using a BET type specific surface area measuring device (FLOWSORP II 2300, manufactured by Shimadzu Corporation).

Here, in the case where the average particle diameter is more than 0.20 μm or the specific surface area value is less than 45 $m^2/g$, there is a tendency that the pigment particles become coarse or the aggregates of the pigment particles are formed. As a result, there is also a tendency that defects in characteristics such as dispersibility, sensitivity, chargeability, and dark decay characteristics easily occur, whereby defects in the image quality easily occur in some cases.

The maximum particle diameter of the hydroxygallium phthalocyanine pigment (the maximum value of primary particle diameters) is preferably 1.2 μm or less, more preferably 1.0 μm or less, and still more preferably 0.3 μm or less. When the maximum particle diameter is over the above range, there is a tendency that the black spots are easily generated.

It is preferable that the hydroxygallium phthalocyanine pigment has an average particle diameter of 0.2 μm or less, a maximum particle diameter of 1.2 μm or less, and a specific surface area value of 45 $m^2/g$ or more, from the viewpoint that the photoreceptor prevents the deviation in the concentrations due to exposure to fluorescence or the like.

The hydroxy gallium phthalocyanine pigment is preferably of a Type V having diffraction peaks at the positions at Bragg angles (2θ±0.2°) of at least 7.3°, 16.0°, 24.9°, and 28.0° in an X-ray diffraction spectrum using CuKα characteristic X-rays.

On the other hand, the chlorogallium phthalocyanine pigment is preferably, for example, one having diffraction peaks at the positions at Bragg angles (2θ±0.2°) of at least 7.4°, 16.6°, 25.5°, and 28.3°, which may provides excellent sensitivity for the electrophotographic photoreceptor material.

In addition, the maximum peak wavelength of the spectral absorption spectrum, average particle diameter, maximum particle diameter and the specific surface area value, each of which is suitable for the chlorogallium phthalocyanine pigment, are the same as those of the hydroxygallium phthalocyanine pigment.

The content of the charge generating material with respect to the total solid content of the photosensitive layer is preferably from 1% by weight to 5% by weight, and preferably from 1.2% by weight to 4.5% by weight.

Hole Transporting Material

Examples of the hole transporting material include a triarylamine compound, a benzidine compound, an arylalkane compound, an aryl-substituted ethylene compound, a stilbene compound, an anthracene compound, and a hydrazone compound. These hole transporting materials may be used singly or as a mixture of two or more kinds thereof, but are not limited thereto.

As the hole transporting material, for example, a compound represented by the formula (3) (hereinafter also referred to as a "hole transporting material of the formula (3)"), a compound represented by the formula (B-1), a compound represented by the formula (B-2), and a compound represented by the formula (B-3) are preferable, from the viewpoint of charge mobility. Among these, from the viewpoint of obtaining higher sensitivity of the singlelayer type photoreceptor, the hole transporting material of the formula (3) is particularly preferable.

(3)

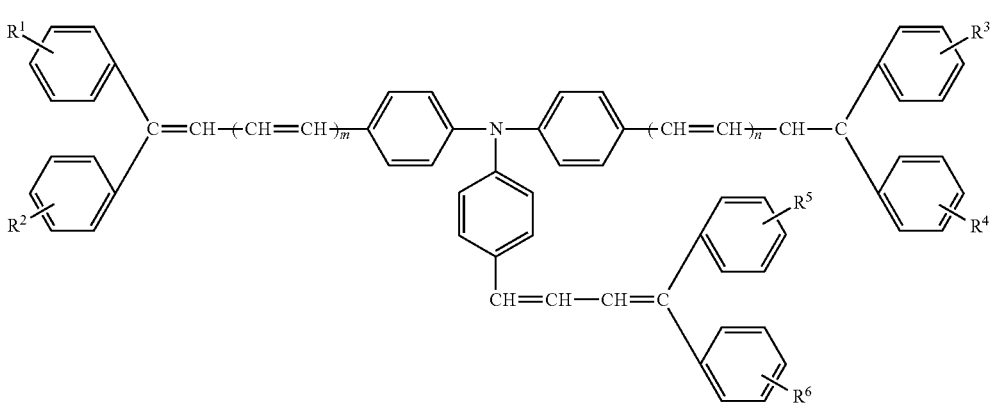

In the formula (3), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, a lower alkoxy group, and a halogen atom, and m and n each independently represent 0 or 1.

In the formula (3), examples of the lower alkyl group represented by $R^1$ to $R^6$ include a linear or branched alkyl group having 1 to 4 carbon atoms, and specifically, for example, a methyl group, an ethyl group, a n-propyl group, an isopropyl group, a n-butyl group, and an isobutyl. Among these, as the lower alkyl group, a methyl group and an ethyl group are preferable.

In the formula (3), examples of the alkoxy group represented by $R^1$ to $R^6$ include an alkoxy group having 1 to 4 carbon atoms, and specifically, for example, a methoxy group, an ethoxy group, a propoxy group, and a butoxy group.

In the formula (3), examples of the halogen atom represented by $R^1$ to $R^6$ include a fluorine atom, a chlorine atom, a bromine atom, and an iodine atom.

In the formula (3), examples of the phenyl group represented by $R^1$ to $R^6$ include an unsubstituted phenyl group; a lower alkyl group-substituted phenyl group such as a p-tolyl group and a 2,4-dimethylphenyl group; a lower alkoxy group-substituted phenyl group such as a p-methoxyphenyl group; and a halogen atom-substituted phenyl group such as a p-chlorophenyl group.

In addition, examples of the substituent which may substitute the phenyl group include the lower alkyl groups, the lower alkoxy groups, and the halogen atoms, represented by $R^1$ to $R^6$.

Among the hole transporting materials of the formula (3), the hole transporting materials in which m and n represent 1 are preferable, and the hole transporting materials in which $R^1$ to $R^6$ each independently represent a hydrogen atom, a lower alkyl group, or an alkoxy group, and m and n represent 1 are more preferable, from the viewpoint of obtaining high sensitivity and preventing the generation of color spots.

Exemplary compounds of the hole transporting material of the formula (3) are shown below, but the invention is not limited thereto. In addition, the following exemplary compound Nos. are denoted as Exemplary compound (3-No.) below. Specifically, for example, Exemplary compound 15 is denoted as "Exemplary compound (3-15)".

| Exemplary compound | m | n | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |
| 8 | 1 | 1 | 4-MeO | H | 4-Meo | H | 4-MeO | H |
| 9 | 1 | 1 | H | H | H | H | 4-MeO | 4-MeO |
| 10 | 1 | 1 | 4-MeO | 4-MeO | 4-MeO | 4-MeO | 4-MeO | 4-MeO |
| 11 | 1 | 1 | 4-MeO | H | 4-MeO | H | 4-MeO | 4-MeO |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-MeO | 4-Me | 4-Me | 4-Me | 4-Me |

-continued

| Exemplary compound | m | n | $R^1$ | $R^2$ | $R^3$ | $R^4$ | $R^5$ | $R^6$ |
|---|---|---|---|---|---|---|---|---|
| 18 | 1 | 1 | 3-Me | 4-MeO | 3-Me | 4-MeO | 3-Me | 4-MeO |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |
| 27 | 1 | 0 | 4-Me | H | H | H | 4-Me | H |
| 28 | 1 | 0 | 4-MeO | H | H | H | 4-MeO | H |
| 29 | 1 | 0 | H | H | 4-MeO | 4-MeO | H | H |
| 30 | 1 | 0 | 4-MeO | 4-MeO | 4-MeO | 4-MeO | 4-MeO | 4-MeO |
| 31 | 1 | 0 | 4-MeO | H | 4-MeO | H | 4-MeO | 4-MeO |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-MeO | 4-Me | 4-MeO | 4-Me | 4-MeO |
| 38 | 1 | 0 | 3-Me | 4-MeO | 3-Me | 4-MeO | 3-Me | 4-MeO |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-MeO | H | 4-MeO | H | H | H |
| 49 | 0 | 0 | H | H | H | H | 4-MeO | 4-MeO |
| 50 | 0 | 0 | 4-MeO | 4-MeO | 4-MeO | 4-MeO | 4-MeO | 4-MeO |
| 51 | 0 | 0 | 4-MeO | H | 4-MeO | H | 4-MeO | 4-MeO |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-MeO | 4-Me | 4-MeO | 4-Me | 4-MeO |
| 58 | 0 | 0 | 3-Me | 4-MeO | 3-Me | 4-MeO | 3-Me | 4-MeO |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |
| 62 | 1 | 1 | 4-PhO | 4-PhO | 4-PhO | 4-PhO | 4-PhO | 4-PhO |
| 63 | 1 | 1 | H | 4-Me | H | 4-Me | H | 4-Me |
| 64 | 1 | 1 | 4-$C_6H_5$ | 4-$C_6H_5$ | 4-$C_6H_5$ | 4-$C_6H_5$ | 4-$C_6H_5$ | 4-$C_6H_5$ |

Furthermore, the abbreviated symbols in the exemplary compounds represent the following meanings.

4-Me: Methyl group substituted at the 4-position of a phenyl group

3-Me: Methyl group substituted at the 3-position of a phenyl group

4-Cl: Chlorine atom substituted at the 4-position of a phenyl group

4-MeO: Methoxy group substituted at the 4-position of a phenyl group

4-F: Fluorine atom substituted at the 4-position of a phenyl group

4-Pr: Propyl group substituted at the 4-position of a phenyl group

4-PhO: Phenoxy group substituted at the 4-position of a phenyl group (B-1)

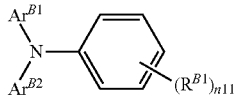

In the formula (B-1), $R^{B1}$ represents a hydrogen atom or a methyl group. n11 represents 1 or 2. $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$, and $R^{B3}$ to $R^{B7}$ each independently represent a hydrogen atom, a substituted or unsubstituted alkyl group, or a substituted or unsubstituted aryl group. The substituent represents a halogen atom, an alkyl group having 1 to 5 carbon atoms, an alkoxy group having 1 to 5 carbon atoms, or a substituted amino group which is substituted with an alkyl group having 1 to 3 carbon atoms.

(B-2)

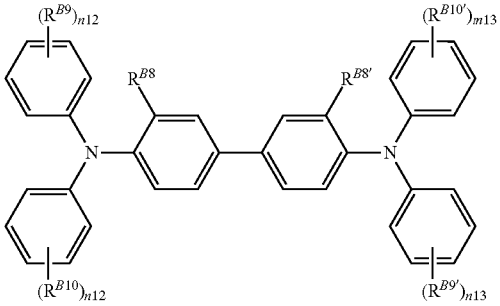

In the formula (B-2), $R^{B8}$ and $R^{B8'}$ may be the same as or different from each other, and each independently represent a hydrogen atom, a halogen atom, an alkyl group having 1 to 5 carbon atoms, or an alkoxy group having 1 to 5 carbon atoms. $R^{B9}$, $R^{B9'}$, $R^{B10}$, and $R^{B10'}$ may be the same as or different from each other, and each independently a halogen atom, an alkyl group having 1 to 5 carbon atoms, an alkoxy group having 1 to 5 carbon atoms, or an amino group substituted with an alkyl group having 1 or 2 carbon atoms, a substituted or unsubstituted aryl group, $—C(R^{B11})=C(R^{B12})(R^{B13})$, or $—CH=CH—CH=C(R^{B14})(R^{B15})$ $R^{B11}$ to $R^{B15}$ each independently represent a hydrogen atom, a substituted or unsubstituted alkyl group, or a substituted or unsubstituted aryl group, and m12, m13, n12, and n13 each independently represent an integer of 0 to 2.

(B-3)

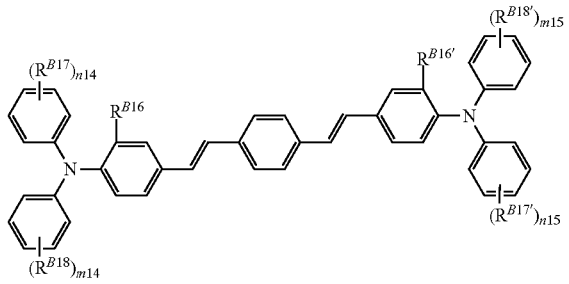

In the formula (B-3), $R^{B16}$ and $R^{B16'}$ may be the same as or different from each other, and each independently represent a hydrogen atom, a halogen atom, an alkyl group having 1 to 5 carbon atoms, or an alkoxy group having 1 to 5 carbon atoms. $R^{B17}$, $R^{B17'}$, $R^{B18}$, and $R^{B18'}$ may be the same as or different from each other, and each independently a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{B19})=C(R^{B20})(R^{B21})$, or $—CH=CH—CH=C(R^{B22})(R^{B23})$, $R^{B19}$ to $R^{B23}$ each independently represent a hydrogen atom, a substituted or unsubstituted alkyl group, or a substituted or unsubstituted aryl group, and m14, m15, n14, and n15 each independently represent an integer of 0 to 2.

Here, among the compounds represented by the formula (B-1), the compounds represented by the formula (B-2), and the compounds represented by the formula (B-3), in particular, the compound represented by the formula (B-1) having "$—C_6H_4—CH=CH—CH=C(R^{B6})(R^{B7})$" and the compound represented by the formula (B-2) having "$—CH=CH—CH=C(R^{B14})(R^{B15})$" are preferable.

Here, specific examples of the compound represented by the formula (B-1), the compound represented by the formula (B-2), and the compound represented by the formula (B-3) include the following compounds.

HT-1

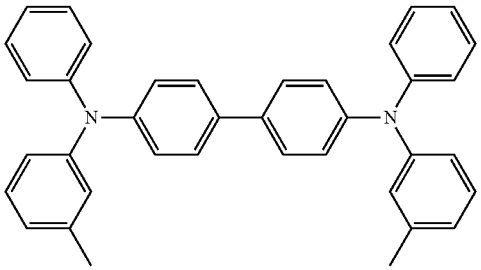

HT-2

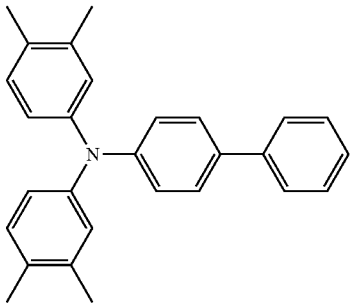

-continued
HT-3
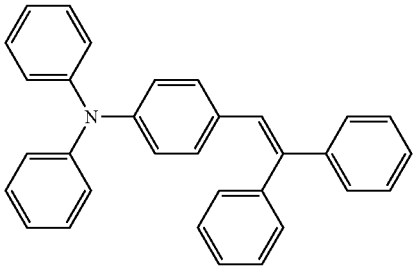
HT-4
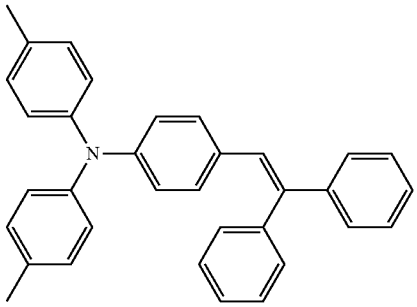
HT-5
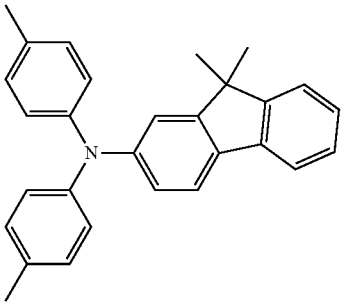
HT-6
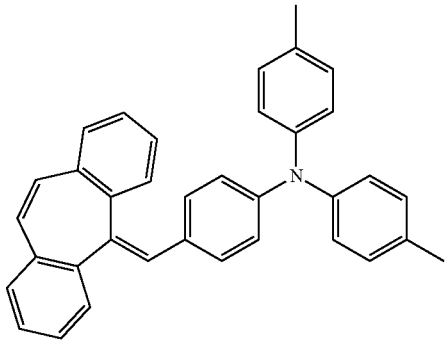
HT-7
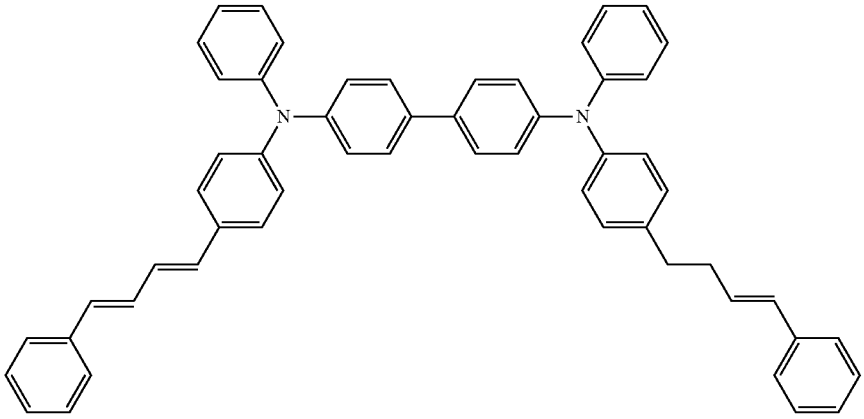
HT-8
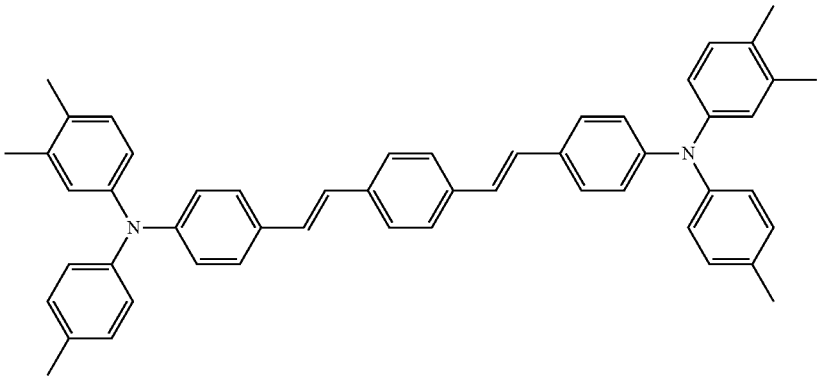

-continued

HT-9

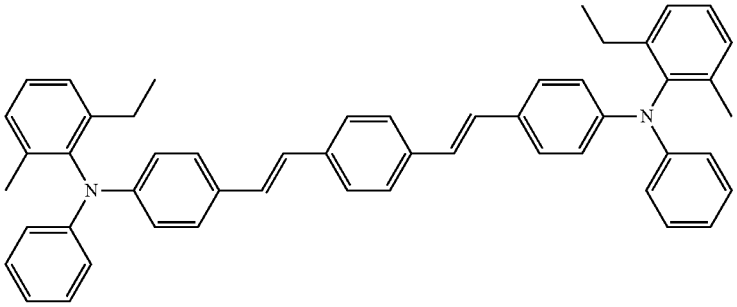

The content of the hole transporting material with respect to the total solid content of the photosensitive layer is preferably from 10% by weight to 40% by weight, and more preferably from 20% by weight to 35% by weight. Further, the content of the hole transporting material is the total content of these hole transporting materials in the case of using a combination of two or more kinds of hole transporting materials.

Electron Transporting Material

As the electron transporting material, the electron transporting material of the formula (1) (electron transporting material represented by the formula (1)) are applied.

(1)

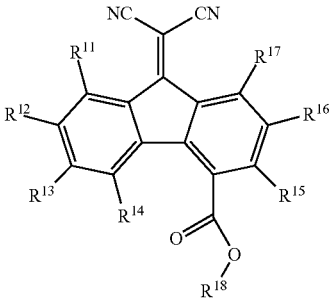

In the formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group, and $R^{18}$ represents an alkyl group, an aryl group, or an aralkyl group.

In the formula (1), examples of the halogen atom represented by $R^{11}$ to $R^{17}$ include a fluorine atom, a chlorine atom, a bromine atom, and an iodine atom.

In the formula (1), examples of the alkyl group represented by $R^{11}$ to $R^{17}$ include a linear or branched alkyl group having 1 to 4 carbon atoms (preferably 1 to 3 carbon atoms), specifically, for example, a methyl group, an ethyl group, a n-propyl group, an isopropyl group, a n-butyl group, and an isobutyl group.

In the formula (1), examples of the alkoxy group represented by $R^{11}$ to $R^{17}$ include an alkoxy group having 1 to carbon atoms (preferably 1 to 3 carbon atoms), and specifically, a methoxy group, an ethoxy group, a propoxy group, and a butoxy group.

In the formula (1), examples of the aryl group represented by $R^{11}$ to $R^{17}$ include a phenyl group and a tolyl group. Among these, as the aryl group represented by $R^{11}$ to $R^{17}$, a phenyl group is preferable.

In the formula (1), examples of the aralkyl group represented by $R^{11}$ to $R^{17}$ include a benzyl group, a phenethyl group, and a phenylpropyl group.

In the formula (1), examples of the alkyl group represented by $R^{18}$ include a linear alkyl group having 1 to 15 carbon atoms (preferably 3 to 12 carbon atoms) and a branched alkyl group having 3 to 15 carbon atoms (preferably 3 to 12 carbon atoms).

Examples of the linear alkyl group having 1 to 15 carbon atoms include a methyl group, an ethyl group, a n-propyl group, a n-butyl group, a n-pentyl group, a n-hexyl group, a n-heptyl group, a n-octyl group, a n-nonyl group, and a n-decyl group.

Examples of the branched alkyl group having 3 to 15 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the formula (1), examples of the aryl group represented by $R^{18}$ include a phenyl group, a methylphenyl group, and a dimethylphenyl group.

In the formula (1), examples of the aralkyl group represented by $R^{18}$ include a group represented by —$R^{19}$—Ar, provided that $R^{19}$ represents an alkylene group and Ar represents an aryl group.

Examples of the alkylene group represented by $R^{19}$ include a linear or branched alkylene group having 1 to 8 carbon atoms, such as a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of the aryl group represented by Ar include a phenyl group, a methylphenyl group, and a dimethylphenyl group.

In the formula (1), specific examples of the aralkyl group represented by $R^{18}$ include a benzyl group, a methylbenzyl group, a dimethylbenzyl group, a phenylethyl group, a methylphenylethyl group, a phenylpropyl group, and a phenylbutyl group.

As the electron transporting material of the formula (1), the electron transporting material, in which $R^{18}$ represents an alkyl group having 3 to 12 carbon atoms, an aryl group, or an aralkyl group is preferable from the viewpoint of obtaining higher sensitivity of the singlelayer type photoreceptor. In particular, as the electron transporting material of the formula (1), the electron transporting material, in which $R^{11}$ to $R^{17}$ each independently represent a hydrogen atom, a halogen atom, or an alkyl group, and $R^{18}$ represents an alkyl group having 3 to 12 carbon atoms, an aryl group, or an aralkyl group, is preferable.

Exemplary compounds of the electron transporting material represented by the formula (1) are shown below, but the invention is not limited thereto. In addition, the following exemplary compound Nos. are denoted as Exemplary compound (1-No.) below. Specifically, for example, Exemplary compound 15 is denoted as "Exemplary compound (1-15)".

| Exemplary compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | -n-$C_7H_{18}$ |
| 2 | H | H | H | H | H | H | H | -n-$C_8H_{17}$ |
| 3 | H | H | H | H | H | H | H | -n-$C_5H_{11}$ |
| 4 | H | H | H | H | H | H | H | -n-$C_{10}H_{21}$ |
| 5 | Cl | Cl | Cl | Cl | Cl | Cl | Cl | -n-$C_7H_{15}$ |
| 6 | H | Cl | H | Cl | H | Cl | Cl | -n-$C_7H_{15}$ |
| 7 | $CH_3$ | $CH_3$ | $CH_3$ | $CH_3$ | $CH_3$ | $CH_3$ | $CH_3$ | -n-$C_7H_{15}$ |
| 8 | $C_4H_9$ | $C_4H_9$ | $C_4H_9$ | $C_4H_9$ | $C_4H_9$ | $C_4H_9$ | $C_4H_9$ | -n-$C_7H_{15}$ |
| 9 | $CH_3O$ | H | $CH_3O$ | H | $CH_3O$ | H | $CH_3O$ | -n-$C_8H_{17}$ |
| 10 | $C_6H_5$ | $C_6H_5$ | $C_6H_5$ | $C_5H_3$ | $C_6H_5$ | $C_5H_3$ | $C_6H_5$ | -n-$C_8H_{17}$ |
| 11 | H | H | H | H | H | H | H | -n-$C_4H_9$ |
| 12 | H | H | H | H | H | H | H | -n-$C_{11}H_{23}$ |
| 13 | H | H | H | H | H | H | H | -n-$C_8H_{19}$ |
| 14 | H | H | H | H | H | H | H | —$CH_2$—CH($C_2H_5$)—$C_4H_9$ |
| 15 | H | H | H | H | H | H | H | —(CH2)$_2$—Ph |
| 16 | H | H | H | H | H | H | H | —$(CH_2)_2$—Ph—$C_2H_5$ |

Furthermore, the abbreviated symbols in the exemplary compounds represent the following meanings.

Ph: Phenyl group or phenylene group p-$C_2H_5$: Ethyl group substituted at the para-position The electron transporting material of the formula (1) may be used singly or in combination of two or more kinds thereof. Further, within a range not interfering with the purpose of the present exemplary embodiment, electron transporting materials other than the electron transporting material of the formula (1) may be used in combination, as desired.

Furthermore, the content of the electron transporting material other than the electron transporting material of the formula (1), if contained, is for example, preferably in the range of 10% by weight or less with respect to the entire electron transporting materials.

Examples of the other electron transporting material include electron transporting compounds such as quinone compounds such as p-benzoquinone, chloranil, bromanil, and anthraquinone, tetracyanoquinodimethane compounds, xanthone compounds, benzophenone compounds, cyanovinyl compounds, and ethylene compounds. These other electron transporting materials may be used singly or as a mixture of two or more kinds thereof, but are not limited thereto.

Fluorenone Compound

As the fluorenone compound, a fluorenone compound of the formula (2) (fluorenone compound represented by the formula (2)) is applied.

(2)

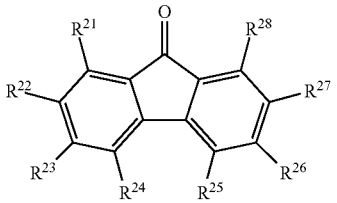

In the formula (2), $R^{21}$, $R^{22}$, $R^{23}$, $R^{24}$, $R^{26}$, $R^{27}$, and $R^{28}$ each independently represent a hydrogen atom, a halogen atom, an alkyl group, an alkoxy group, an aryl group, or an aralkyl group. $R^{25}$ represents a hydrogen atom, a halogen atom, an alkyl group, an alkoxy group, an aryl group, or an aralkyl group.

In the formula (2), examples of the halogen atom represented by $R^{21}$ to $R^{24}$ and $R^{26}$ to $R^{28}$ include a fluorine atom, a chlorine atom, a bromine atom, and an iodine atom.

In the formula (2), examples of the alkyl group represented by $R^{21}$ to $R^{24}$ and $R^{26}$ to $R^{28}$ include a linear or branched alkyl group having 1 to 4 carbon atoms (preferably 1 to 3 carbon atoms), and specifically, for example, a methyl group, an ethyl group, a n-propyl group, an isopropyl group, a n-butyl group, and an isobutyl group.

In the formula (2), examples of the alkoxy group represented by $R^{21}$ to $R^{24}$ and $R^{26}$ to $R^{28}$ include an alkoxy group having 1 to 4 carbon atoms (preferably 1 to 3 carbon atoms). Specific examples thereof include a methoxy group, an ethoxy group, a propoxy group, and a butoxy group.

In the formula (2), examples of the aryl group represented by $R^{21}$ to $R^{24}$ and $R^{26}$ to $R^{28}$ include a phenyl group and a tolyl group. Among these, a phenyl group is preferable.

In the formula (2), examples of the aralkyl group represented by $R^{21}$ to $R^{24}$ and $R^{26}$ to $R^{28}$ include a benzyl group, a phenethyl group, and a phenylpropyl group.

In the formula (2), examples of the halogen atom represented by $R^{25}$ include a fluorine atom, a chlorine atom, a bromine atom, and an iodine atom.

In the formula (2), examples of the alkyl group represented by $R^{25}$ include a linear alkyl group having 1 to 10 carbon atoms, and a branched alkyl group having 3 to 10 carbon atoms.

Examples of the linear alkyl group having 1 to 10 carbon atoms include a methyl group, an ethyl group, a n-propyl group, a n-butyl group, a n-pentyl group, a n-hexyl group, a n-heptyl group, a n-octyl group, a n-nonyl group, and a n-decyl group.

Examples of the branched alkyl group having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the formula (2), examples of the alkoxy group represented by $R^{25}$ include a linear alkoxy group having 1 to 10 carbon atoms and a branched alkoxy group having 3 to 10 carbon atoms. Examples of the linear alkoxy group having 1 to 10 carbon atoms include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group.

Examples of the branched alkoxy group having 3 to 10 carbon atoms include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

In the formula (2), examples of the aryl group represented by $R^{25}$ include a phenyl group, a methylphenyl group, and a dimethylphenyl group.

In the formula (2), examples of the aralkyl group represented by $R^{25}$ include a group represented by —$R^{29}$—Ar, provided that $R^{29}$ represents an alkylene group, and Ar represents an aryl group.

Examples of the alkylene group represented by $R^{19}$ include a linear or branched alkylene group having 1 to 8 carbon atoms, such as a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of the aryl group represented by Ar include a phenyl group, a methylphenyl group, and a dimethylphenyl group.

In the formula (2), specific examples of the aralkyl group represented by $R^{25}$ include a benzyl group, a methylbenzyl group, a dimethylbenzyl group, a phenylethyl group, a methylphenylethyl group, a phenylpropyl group, and a phenylbutyl group.

As the fluorenone compound of the formula (2), the fluorenone compound in which $R^{21}$ to $R^{24}$ and $R^{26}$ to $R^{28}$ each independently represent a hydrogen atom, a halogen atom, an alkyl group (for example, an alkyl group having 1 to 3 carbon atoms), or an alkoxy group (for example, an alkoxy group having 1 to 3 carbon atoms), and $R^{25}$ represents a hydrogen atom, a halogen atom, an alkyl group (for example, an alkyl group having 1 to 3 carbon atoms), or an alkoxy group (for example, an alkoxy group having 1 to 3 carbon atoms) is preferable, from the viewpoint of prevention of the generation of color spots.

Exemplary compounds of the fluorenone compound of the formula (2) are shown below, but the invention is not limited thereto. In addition, the following exemplary compound Nos. are denoted as Exemplary compound (2-No.) below. Specifically, for example, Exemplary compound 3 is denoted as "Exemplary compound (2-3)".

| Exemplary compound | $R^{21}$ | $R^{22}$ | $R^{23}$ | $R^{24}$ | $R^{25}$ | $R^{26}$ | $R^{27}$ | $R^{28}$ |
|---|---|---|---|---|---|---|---|---|
| 1 | H | H | H | H | H | H | H | H |
| 2 | $CH_3$ | $CH_3$ | $CH_3$ | $CH_3$ | $CH_3$ | $CH_3$ | $CH_3$ | $CH_3$ |
| 3 | H | H | H | H | —O—$C_4H_9$ | H | H | H |
| 4 | H | H | H | H | —O—$C_8H_{17}$ | H | H | H |
| 5 | H | H | H | H | —$(CH_2)_2$—Ph | H | H | H |
| 6 | H | H | H | H | —$(CH_2)_2$—Ph—$CH_3$ | H | H | H |

Furthermore, the abbreviated symbols in the exemplary compounds represent the following meanings.

Ph: Phenyl group or phenylene group

Contents of Electron Transporting Material of the Formula (1) and Fluorenone Compound of the Formula (2)

The content of the electron transporting material of the formula (1) is from 5% by weight to 15% by weight with respect to the total solid content of the photosensitive layer, and the total content of the electron transporting material of the formula (1) and the fluorenone compound of the formula (2) is preferably from 15% by weight to 30% by weight with respect to the total solid content of the photosensitive layer.

By setting the content of the electron transporting material of the formula (1) within the above range, the sensitivity of the singlelayer type photosensitive layer is improved by the electron transporting material of the formula (1) and the charging failure of the photoreceptor by excess inclusion of the electron transporting material of the formula (1) is easily prevented. Further, by setting the total content of the electron transporting material of the formula (1) and the fluorenone compound of the formula (2) within the above range, the generation of color spots is easily prevented.

In addition, from the same viewpoint, the content of the electron transporting material of the formula (1) is more preferably from 8% by weight to 15% by weight with respect to the total solid content of the photosensitive layer. Further, the total content of the electron transporting material of the formula (1) and the fluorenone compound of the formula (2) is more preferably from 18% by weight to 25% by weight with respect to the total solid content of the photosensitive layer.

Ratio of Hole Transporting Material to Electron Transporting Material

The ratio of the hole transporting material to the electron transporting material is preferably from 50/50 to 90/10, and more preferably from 60/40 to 80/20 in terms of a weight ratio (hole transporting material/electron transporting material).

In addition, in the case where a combination of the charge transporting materials is used, the present ratio is a ratio of a sum thereof.

Other Additives

The singlelayer type photosensitive layer may include known additives such as an antioxidant, a light stabilizer, and a heat stabilizer. Further, in the case where the singlelayer type photosensitive layer is a surface layer, it may include fluorine resin particles, a silicone oil, or the like.

Formation of Singlelayer Type Photosensitive Layer

The singlelayer type photosensitive layer is formed using a coating liquid for forming a photosensitive layer, obtained by adding the components in a solvent.

Examples of the solvent include ordinary organic solvents, such as aromatic hydrocarbons such as benzene, toluene, xylene, and chlorobenzene; ketones such as acetone and 2-butanone; aliphatic hydrocarbon halides such as methylene chloride, chloroform, and ethylene chloride; and cyclic or straight-chained ethers such as tetrahydrofuran and ethyl ether. These solvents may be used singly or in combination of two or more kinds thereof.

Furthermore, for a method for dispersing particles (for example, a charge generating material) in the coating liquid for forming a photosensitive layer, for example, a media dispersing machine such as a ball mill, a vibrating ball mill, an attritor, a sand mill, and a horizontal sand mill; or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion liquid to collide against liquid or against walls under a high pressure, and a penetration system in which the particles are dispersed by causing the dispersion liquid to penetrate through a fine flow path under a high-pressure state.

Furthermore, as a method for applying the coating liquid for forming a photosensitive layer to an undercoat layer include a dipping coating method, an extrusion coating method, a wire bar coating method, a spraying method, a blade coating method, a knife coating method, and a curtain coating method.

The film thickness of the singlelayer type photosensitive layer is set to a range of preferably from 5 μm to 60 μm, more preferably from 5 μm to 50 μm, and still more preferably from 10 μm to 40 μm.

Protective Layer

A protective layer is provided on the photosensitive layer, as desired. The protective layer is provided for the purpose of, for example, preventing the chemical change of the photosensitive layer during charging, or further improving the mechanical strength of the photosensitive layer.

Thus, for the protective layer, a layer constituted with a cured film (crosslinked film) is preferably applied. Examples of these layers include the layers shown in 1) or 2) below.

1) A layer constituted with a cured film of a composition including a reactive group-containing charge transporting material having a reactive group and a charge transporting skeleton in the same molecule (that is, a layer including a polymer or a crosslinked form of the reactive group-containing charge transporting material).

2) A layer constituted with a cured film of a composition including a non-reactive charge transporting material and a reactive group-containing non-charge transporting material having no charge transporting skeleton and a reactive group (that is, a layer including a polymer or a crosslinked form of the non-reactive charge transporting material and the reactive group-containing non-charge transporting material).

Examples of the reactive group of the reactive group-containing charge transporting material include known reactive groups such as a chain polymerizable group, an epoxy group, —OH, —OR [provided that R represents an alkyl group], —$NH_2$, —SH, —COOH, and —$SiR^{Q1}{}_{3-Qn}(OR^{Q2})_{Qn}$, [provided that $R^{Q1}$ represents a hydrogen atom, an alkyl group, or an substituted or unsubstituted aryl group, $R^{Q2}$ represents a hydrogen atom, an alkyl group, or a trialkylsilyl group, and Qn represents an integer of 1 to 3].

The chain polymerizable group is not particularly limited as long as it is a functional group capable of radical polymerization, and it is, for example, a functional group having at least a carbon double bond. Specific examples thereof include a group containing at least one selected from a vinyl group, a vinyl ether group, a vinyl thioether group, a vinylphenyl group, a styryl group, an acryloyl group, a methacryloyl group, and derivatives thereof, and the like. Among these, in terms of excellent reactivity, the chain polymerizable group is preferably a group containing at least one selected from a vinyl group, a vinylphenyl group, a styryl group, an acryloyl group, a methacryloyl group, and derivatives thereof.

The charge transporting skeleton of the reactive group-containing charge transporting material is not particularly limited as long as it has a known structure in the electrophotographic photoreceptor, and examples thereof include skeletons derived from nitrogen-containing hole transporting compounds such as a triarylamine compound, a benzidine compound, and a hydrazone compound, and include structures conjugated with nitrogen atoms. Among these, a triarylamine skeleton is preferable.

These reactive group-containing charge transporting materials having a reactive group and a charge transporting skeleton, non-reactive charge transporting materials, and reactive group-containing non-charge transporting materials may be selected from known materials.

A known additive may be additionally included in the protective layer.

For the formation of the protective layer, known forming methods are used without particular limitation. For example, the formation of the protective layer is carried out by forming a coating film of the coating liquid for forming a protective layer obtained by adding the components to the solvent, drying the coating film, and performing a curing treatment such as heating, as desired.

Examples of the solvent for preparing a coating liquid for forming a protective layer include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used singly or as a mixture of 2 or more kinds thereof.

In addition, the coating liquid for forming a protective layer may be a solvent-free coating liquid.

As a method for coating the coating liquid for forming a protective layer onto a photosensitive layer (for example charge transporting layer) include ordinary methods such as a dipping coating method, a thrust-up coating method, a wire bar coating method, a spraying method, a blade coating method, a knife coating method, and a curtain coating method.

The film thickness of the protective layer is set to a range of, for example, preferably from 1 μm to 20 μm, and more preferably from 2 μm to 10 μm.

Image Forming Apparatus (and Process Cartridge)

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of the charged electrophotographic photoreceptor, a developing unit that develops the electrostatic latent image formed on the surface of the electrophotographic photoreceptor by a developer including a toner to forma toner image, and a transfer unit that transfers the toner image onto a surface of a recording medium. Further, the electrophotographic photoreceptor according to the present exemplary embodiment is applied as the electrophotographic photoreceptor.

As the image forming apparatus according to the present exemplary embodiment, known image forming apparatuses provided with a device including a fixing unit that fixes a toner image transferred to the surface of a recording medium; a direct transfer type device that directly transfers the toner image formed on the surface of the electrophotographic photoreceptor to a recording medium; an intermediate transfer type device that primarily transfers the toner image formed on the surface of the electrophotographic photoreceptor to the surface of the intermediate transfer member, and secondarily transfers the toner image transferred to the surface of an intermediate transfer member to the surface of the recording medium; a device provided with a cleaning unit that cleans the surface of the electrophotographic photoreceptor before charging, after the transfer of the toner image; a device provided with a charge erasing unit that erases charges by irradiating the surface of the electrophotographic photoreceptor with charge erasing light before charging, after the transfer of the toner image; a device provided with an electrophotographic photoreceptor heating unit that increases the temperature of the electrophotographic photoreceptor to reduce the relative temperature; and the like are applied.

In the case of the intermediate transfer type device, for the transfer unit, for example, a configuration in which an intermediate transfer member to the surface of which the toner image is transferred, a first transfer unit that primarily transfers a toner image formed on the surface of the electrophotographic photoreceptor to the surface of the intermediate transfer member, and a secondary transfer unit that secondarily transfers the toner image transferred to the surface of the intermediate transfer member to the surface of the recording medium is applied.

The image forming apparatus according to the present exemplary embodiment is anyone of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging means, an electrostatic latent image forming unit, a developing unit, and a transfer unit.

One example of the image forming apparatuses according to the present exemplary embodiment is shown below, but the present invention is not limited thereto. Further, the main parts shown in the figures are described, and explanation of the others will be omitted.

Figure 2:
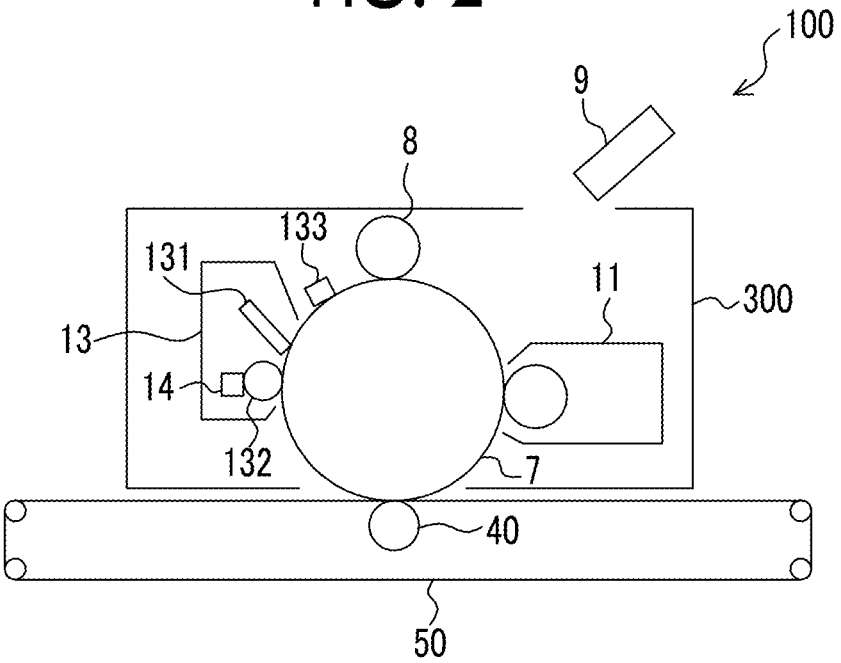
FIG. 2 is a schematic structural view showing an image forming apparatus according to the present exemplary embodiment.

FIG. 2 is a schematic structural view showing an example of the image forming apparatus according to the present exemplary embodiment.

The image forming apparatus 100 according to the present exemplary embodiment, as shown in FIG. 2, is provided with a process cartridge 300 provided with an electrophotographic photoreceptor 7, an exposure device 9 (one example of the electrostatic latent image forming unit), a transfer device (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to be partially in contact with the electrophotographic photoreceptor 7. Further, although not shown in the figure, the apparatus also includes a secondary transfer device that transfers a toner image transferred onto the intermediate transfer member 50 to a recording medium (for example, paper). In addition, the intermediate transfer member 50, the transfer device 40 (primary transfer device), and the secondary transfer device (not shown) correspond to an example of the transfer unit.

The process cartridge 300 in FIG. 2 supports, in a housing, the electrophotographic photoreceptor 7, a charging device 8 (one example of the charging unit), a developing device 11 (one example of the developing unit), and a cleaning device 13 (one example of the cleaning unit) in an integrated manner. The cleaning device 13 has a cleaning blade (one example of the cleaning member) 131, and the cleaning blade 131 is arranged so as to be in contact with the surface of the electrophotographic photoreceptor 7. Further, the cleaning member is not an embodiment of the cleaning blade 131, may be a conductive or insulating fibrous member, and may be used singly or in combination with the cleaning blade 131.

In addition, FIG. 2 shows an example of the image forming apparatus including a fibrous member 132 (in a roll shape) supplying a lubricant 14 to the surface of the electrophotographic photoreceptor 7 and a fibrous member 133 (in a flat brush shape) assisting the cleaning process, but these are disposed, as desired.

The respective configurations of the image forming apparatus according to the present exemplary embodiment will be described below.

Charging Device

As the charging device 8, for example, a contact type charging device using a conductive or semiconductive charging roll, a charging brush, a charging film, a charging rubber blade, a charging tube, or the like is used. Further, known charging devices themselves, such as a non-contact type roller charging device, and a scorotron charging device and a corotron charging device, each using corona discharge, are also used.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a magnetic or non-magnetic single-component or two-component developer is contacted or not contacted for forming an image, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these, the developing device using developing roller retaining developer on the surface thereof is preferable.

The developer used in the developing device 11 may be a single-component developer formed of a toner alone or a two-component developer formed of a toner and a carrier. Further, the toner may be magnetic or non-magnetic. As the developer, known ones may be applied.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be employed.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 3:
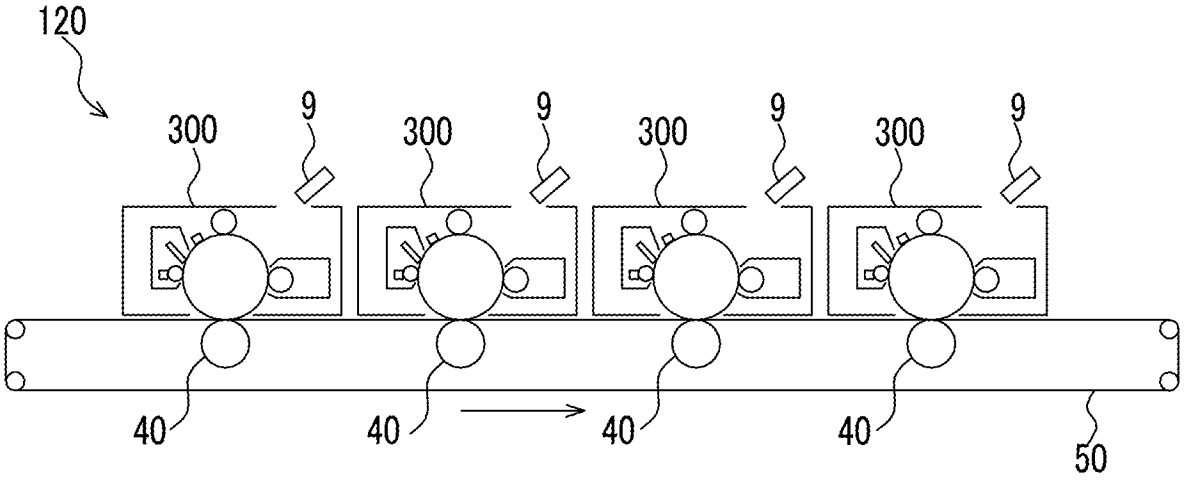
FIG. 3 is a schematic structural view showing another image forming apparatus according to the present exemplary embodiment.

FIG. 3 is a schematic structural view showing another example of the image forming apparatus according to the present exemplary embodiment. The image forming apparatus 120 is a tandem-type full color image forming apparatus equipped with four process cartridges 300. In the image forming apparatus 120, four process cartridges 300 are disposed parallel with each other on the intermediate transfer member 50, and one electrophotographic photoreceptor may be used for one color. Further, the image forming apparatus 120 has the same configuration as the image forming apparatus 100 except that it is a tandem type.

Furthermore, the image forming apparatus 100 according to the present exemplary embodiment is not limited to the above-described configuration. For example, in order to make uniform polarity of the residual toner and facilitate cleaning with the cleaning brush or the like, a first erasing device may be provided around the electrophotographic photoreceptor 7 so as to be disposed at the downstream side of the transfer device 40 in the rotational direction of the electrophotographic photoreceptor 7 and the upstream side of the cleaning device 13 in the rotational direction of the electrophotographic photoreceptor 7. Further, in order to erase the electricity of the surface of the electrophotographic photoreceptor 7, a second erasing device may be provided at the downstream side of the cleaning device 13 in the rotational direction of the electrophotographic photoreceptor and the upstream side of the charging device 8 in the rotational direction of the electrophotographic photoreceptor.

Moreover, the image forming apparatus 100 according to the present exemplary embodiment is not limited to the above-mentioned configuration, and known configurations, for example, an image forming apparatus in a direct transfer system that directly transfers the toner image formed on the electrophotographic photoreceptor 7 to the recording medium may be employed.

EXAMPLES

The present exemplary embodiments will be described in detail with reference to Examples, but are not construed to be limited to these Examples below. Further, in the following description, "part(s)" and "%" mean "part(s) by weight" and "% by weight" unless otherwise specified.

Example 1

Formation of Photosensitive Layer

A mixture formed of 4 parts by weight of a Type V hydroxygallium phthalocyanine pigment (CGM1) having diffraction peaks at the positions at Bragg angles (2θ±0.2°) of at least 7.3°, 16.0°, 24.9°, and 28.0° in an X-ray diffraction spectrum using CuKα characteristic X-rays as a charge generating material, 58 parts by weight of a bisphenol Z polycarbonate resin (viscosity average molecular weight: 50,000: Binder1) as a binder resin, 15 parts by weight of the electron transporting material (ETM1) shown in Table 1, 20 parts by weight of the hole transporting material (HTM1) shown in Table 1, 3 parts by weight of the additives (FLUO1) shown in Table 1, 150 parts by weight of toluene, and 250 parts by weight of tetrahydrofuran (THF) is dispersed for 4 hours with a sand mill using glass beads having a diameter of 1 mmϕ to obtain a coating liquid for forming a photosensitive layer.

The obtained coating liquid for forming a photosensitive layer is applied to an aluminum substrate having a diameter of 30 mm and a length of 245 mm by a dipping coating method, and subjected to drying and curing at 100° C. for 15 minutes to forma singlelayer type photosensitive layer having a thickness of 30 μm.

Through the above processes, an electrophotographic photoreceptor (1) is prepared.

Examples 2 to 14 and Comparative Examples 1 to 7

In the same manner as in Example 1 except that the types and the amount of the binder resin, the types and the amount of the charge generating material, the types and the amount of the electron transporting material, the types of the hole transporting material, and the types and the amount of the additives are changed in the composition of the coating liquid for forming a photosensitive layer according to Tables 1 and 2, electrophotographic photoreceptors are prepared.

Evaluations

The obtained electrophotographic photoreceptors are evaluated by the following manners. The results thereof are shown in Tables.

Evaluation of Color Spots

For the evaluation of color spots, by using a modified machine of HL5340D manufactured by Brother Industries, Ltd., equipped with a photoreceptor, 2,000 sheets with a half-tone of 50% are printed at a charge voltage of +800 V in a high-temperature and high-humidity environment of 28° C. and 85 RH %, the device is stopped overnight, blank paper is transported into the device the next morning, and at the time, the number of color spots generated on the paper is counted and evaluated according to the following criteria.

A: Color spots are not generated.

B: 1 to 3 color spots are generated.

C: 4 to 9 color spots are generated.

D: 10 or more color spots are generated.

Evaluation of Sensitivity (Half Decay Exposure Amount) of Photoreceptor

For evaluation of the sensitivity of a photoreceptor, a half decay exposure amount is evaluated. With respect to the half decay exposure amount, a half decay exposure amount at a time of charging at +800 V is evaluated. Specifically, by using an electrostatic copying paper tester (Electrostatic Analyzer EPA-8100, manufactured by Kawaguchi Denki Seisakusho K. K.), the photoreceptor is charged to +800 in an environment of 20° C. and 40% RH and then irradiated with monochromatic light with 780 nm obtained from light of a tungsten lamp using a monochromator so as to provide 1 mW/cm$^2$ on the surface of the photoreceptor.

Further, the surface potential $V_0$ (V) of the photoreceptor surface immediately after charging, and the half decay exposure amount E1/2 (mJ/m$^2$) at a time when the surface potential becomes $1/2 \times V_0$ (V) by irradiating the photoreceptor surface with light.

The results are shown in Tables 1 and 2. Further, the evaluation criteria are as follows.

A: Less than 0.8 mJ/m$^2$

B: From 0.8 mJ/m$^2$ to 1.0 mJ/m$^2$

C: 1.0 mJ/m$^2$ or more

Evaluation of Chargeability of Photoreceptor

For evaluation of the chargeability of a photoreceptor, by using a modified machine of HL5340D manufactured by Brother Industries, Ltd., equipped with a photoreceptor, 2,000 sheets with a half-tone of 50% are printed after setting the initial charging potential (VH1) to +800 V in a high-temperature and high-humidity environment of 28° C. and 85 RH %, the device is stopped overnight, and the charging potential (VH2) after printing is measured, and evaluated according to the following criteria.

The results are shown in Tables 1 and 2. Further, the evaluation criteria are as follows.

A: $|VH1-VH2|<15$ V

B: $15 \leq VH1-VH21<30$ V

C: $30\ V \leq |VH1-VH2|$

TABLE 1

| | Electron transporting material | | Additive | | Charge generating material | | Hole transporting material | | Binder Resin | | | Sensitivity (half decay exposure amount) of | |
|---|---|---|---|---|---|---|---|---|---|---|---|---|---|
| | Type of material | Addition amount | Type of material | Addition amount | Type of material | Addition amount | Type of material | Addition amount | Type of material | Addition amount | Color spots | photo-receptor | Chargeability |
| Example 1 | ETM1 | 15% | FULUO1 | 3% | CGM1 | 4% | HTM1 | 20% | Binder1 | 58% | A | A | A |
| Example 2 | ETM1 | 15% | FULUO1 | 5% | CGM1 | 4% | HTM1 | 20% | Binder1 | 56% | A | A | A |
| Example 3 | ETM1 | 15% | FULUO1 | 10% | CGM1 | 4% | HTM1 | 20% | Binder1 | 51% | A | A | A |
| Example 4 | ETM1 | 15% | FULUO1 | 15% | CGM1 | 4% | HTM1 | 20% | Binder1 | 46% | B | A | A |
| Example 5 | ETM1 | 10% | FULUO1 | 5% | CGM1 | 4% | HTM1 | 20% | Binder1 | 61% | B | A | A |
| Example 6 | ETM1 | 10% | FULUO1 | 10% | CGM1 | 4% | HTM1 | 20% | Binder1 | 56% | A | A | A |
| Example 7 | ETM1 | 10% | FULUO1 | 15% | CGM1 | 4% | HTM1 | 20% | Binder1 | 51% | A | A | A |
| Example 8 | ETM1 | 5% | FULUO1 | 10% | CGM1 | 4% | HTM1 | 20% | Binder1 | 61% | B | B | A |
| Example 9 | ETM1 | 5% | FULUO1 | 15% | CGM1 | 4% | HTM1 | 20% | Binder1 | 56% | A | B | A |
| Example 10 | ETM1 | 10% | FULUO2 | 10% | CGM1 | 4% | HTM1 | 20% | Binder1 | 56% | A | A | A |
| Example 11 | ETM1 | 10% | FULUO3 | 10% | CGM1 | 4% | HTM1 | 20% | Binder1 | 56% | A | A | A |
| Example 12 | ETM1 | 10% | FULUO4 | 10% | CGM1 | 4% | HTM1 | 20% | Binder1 | 56% | A | A | A |
| Example 13 | ETM1 | 10% | FULUO5 | 10% | CGM1 | 4% | HTM1 | 20% | Binder1 | 56% | B | A | A |
| Example 14 | ETM1 | 10% | FULUO6 | 10% | CGM1 | 4% | HTM1 | 20% | Binder1 | 56% | B | A | A |

TABLE 2

| | Electron transporting material | | Additive | | Charge generating material | | Hole transporting material | | Binder resin | | | Sensitivity (half decay exposure amount) of | |
|---|---|---|---|---|---|---|---|---|---|---|---|---|---|
| | Type of material | Addition amount | Type of material | Addition amount | Type of material | Addition amount | Type of material | Addition amount | Type of material | Addition amount | Color spots | photo-receptor | Chargeability |
| Comparative Example 1 | ETM1 | 20% | None | 0% | CGM1 | 4% | HTM1 | 20% | Binder1 | 56% | C | A | C |
| Comparative Example 2 | ETM1 | 15% | None | 0% | CGM1 | 4% | HTM1 | 20% | Binder1 | 61% | D | A | A |
| Comparative Example 3 | ETM1 | 10% | None | 0% | CGM1 | 4% | HTM1 | 20% | Binder1 | 66% | D | A | A |

TABLE 2-continued

| | Electron transporting material | | Additive | | Charge generating material | | Hole transporting material | | Binder resin | | | Sensitivity (half decay exposure amount) of | |
|---|---|---|---|---|---|---|---|---|---|---|---|---|---|
| | Type of material | Addition amount | Type of material | Addition amount | Type of material | Addition amount | Type of material | Addition amount | Type of material | Addition amount | Color spots | photo-receptor | Chargeability |
| Comparative Example 4 | ETM1 | 5% | None | 0% | CGM1 | 4% | HTM1 | 20% | Binder1 | 71% | D | B | A |
| Comparative Example 5 | ETM1 | 10% | Biphenyl | 10% | CGM1 | 4% | HTM1 | 20% | Binder1 | 56% | C | A | A |
| Comparative Example 6 | ETM1 | 10% | m-Terphenyl | 10% | CGM1 | 4% | HTM1 | 20% | Binder1 | 56% | C | A | A |
| Comparative Example 7 | ETM1 | 10% | Anthra-quinone | 10% | CGM1 | 4% | HTM1 | 20% | Binder1 | 56% | D | A | A |

From the above results, it may be seen that in the present Examples, generation of color spots is prevented, as compared with Comparative Examples. It may also be seen that in the present Examples, the photoreceptor has high sensitivity.

The details such as abbreviations in Tables 1 and 2 are shown below.

Charge Generating Material

CGM1 (HOGaPC): Hydroxygallium phthalocyanine pigment (Type V): Type V hydroxygallium phthalocyanine pigment having a maximum peak wavelength of 820 nm in a spectral absorption spectrum in a wavelength band of 600 nm to 900 nm, an average particle diameter of 0.12 μm, a maximum particle diameter of 0.2 μm, and a specific surface area value of 60 $m^2/g$) and having diffraction peaks at the positions at Bragg angles (2θ±0.2°) of at least 7.3°, 16.0°, 24.9°, and 28.0° in an X-ray diffraction spectrum using CuKα characteristic X-rays Electron Transporting Material ETM1: Exemplary compound (1-11) of the electron transporting material represented by the formula (1) in which $R^{11}$ to $R^{12}$ each are a hydrogen atom and $R^{18}$ is an $—C_4H_9$ Additives FLUO1: Exemplary compound (2-1) of the fluorenone compound represented by the formula (2)

FLUO2: Exemplary compound (2-2) of the fluorenone compound represented by the formula (2)

FLUO3: Exemplary compound (2-3) of the fluorenone compound represented by the formula (2)

FLUO4: Exemplary compound (2-4) of the fluorenone compound represented by the formula (2)

FLUO5: Exemplary compound (2-5) of the fluorenone compound represented by the formula (2)

FLUO6: Exemplary compound (2-6) of the fluorenone compound represented by the formula (2)

Hole Transporting Material

HTM1: Exemplary compound (3-1) of the hole transporting material represented by the formula (3)

Binder Resin

Binder1: Bisphenol Z polycarbonate resin (viscosity average molecular weight of 50,000)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a singlelayer type photosensitive layer which is provided on the conductive substrate and contains a binder resin, a charge generating material, a hole transporting material, an electron transporting material represented by the formula (1), and a fluorenone compound represented by the formula (2):

(1)

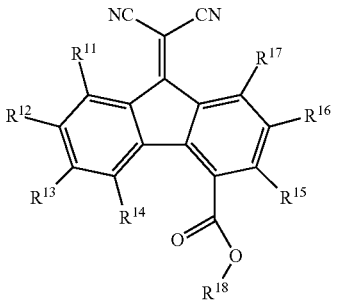

wherein $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group, and $R^{18}$ represents an alkyl group, an aryl group, or an aralkyl group; and (2)

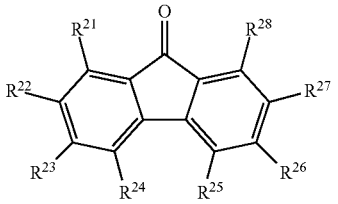

wherein $R^{21}$, $R^{22}$, $R^{23}$, $R^{24}$, $R^{26}$, $R^{27}$, and $R^{28}$ each independently represent a hydrogen atom, a halogen atom, an alkyl group, an alkoxy group, an aryl group, or an aralkyl group, and $R^{25}$ represents a hydrogen atom, a halogen atom, an alkyl group, an alkoxy group, an aryl group, or an aralkyl group.

2. The electrophotographic photoreceptor according to claim 1, wherein the content of the electron transporting material represented by the formula (1) is from 5% by weight to 15% by weight with respect to the total solid content of the photosensitive layer.

3. The electrophotographic photoreceptor according to claim 1, wherein the content of the electron transporting material represented by the formula (1) is from 8% by weight to 15% by weight with respect to the total solid content of the photosensitive layer.

4. The electrophotographic photoreceptor according to claim 1, wherein the total content of the electron transporting material represented by the formula (1) and the fluorenone compound represented by the formula (2) is from 15% by weight to 30% by weight respect to the total solid content of the photosensitive layer.

5. The electrophotographic photoreceptor according to claim 1, wherein the content of the electron transporting material represented by the formula (1) is from 5% by weight to 15% by weight with respect to the total solid content of the photosensitive layer, and the total content of the electron transporting material represented by the formula (1) and the fluorenone compound represented by the formula (2) is from 15% by weight to 30% by weight respect to the total solid content of the photosensitive layer.

6. The electrophotographic photoreceptor according to claim 5, wherein the total content of the electron transporting material represented by the formula (1) and the fluorenone compound represented by the formula (2) is from 18% by weight to 25% by weight respect to the total solid content of the photosensitive layer.

7. The electrophotographic photoreceptor according to claim 1, wherein the weight ratio of the hole transporting material to the electron transporting material (hole transporting material/electron transporting material) is from 50/50 to 90/10.

8. The electrophotographic photoreceptor according to claim 1, wherein the weight ratio of the hole transporting material to the electron transporting material (hole transporting material/electron transporting material) is from 60/40 to 80/20.

9. The electrophotographic photoreceptor according to claim 1, wherein the fluorenone compound represented by the formula (2) is the fluorenone compound of the formula (2), in which $R^{21}$, $R^{22}$, $R^{23}$, $R^{24}$, $R^{26}$, $R^{27}$, and $R^{28}$ each independently represent a hydrogen atom, a halogen atom, an alkyl group, or an alkoxy group, and $R^{25}$ represents a hydrogen atom, a halogen atom, an alkyl group, or an alkoxy group.

10. A process cartridge comprising:

the electrophotographic photoreceptor according to claim 1, wherein the process cartridge is detachable from an image forming apparatus.

11. An image forming apparatus comprising:

the electrophotographic photoreceptor according to claim 1;

a charging unit that charges the surface of the electrophotographic photoreceptor;

an electrostatic latent image forming unit that forms an electrostatic latent image on the surface of the charged electrophotographic photoreceptor;

a developing unit that develops the electrostatic latent image formed on the surface of the electrophotographic photoreceptor by a developer including a toner to form a toner image; and a transfer unit that transfers the toner image to the surface of a recording medium.

* * * * *